US010493481B2

(12) United States Patent
Fritz et al.

(10) Patent No.: US 10,493,481 B2
(45) Date of Patent: Dec. 3, 2019

(54) COATING METHOD AND CORRESPONDING COATING INSTALLATION

(71) Applicant: Dürr Systems AG, Bietigheim-Bissingen (DE)

(72) Inventors: Hans-Georg Fritz, Ostfildern (DE); Benjamin Wöhr, Eibensbach/Güglingen (DE); Marcus Kleiner, Besigheim (DE); Moritz Bubek, Ludwigsburg (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 0 days.

(21) Appl. No.: 15/775,121

(22) PCT Filed: Nov. 14, 2016

(86) PCT No.: PCT/EP2016/001899
§ 371 (c)(1),
(2) Date: May 10, 2018

(87) PCT Pub. No.: WO2017/084748
PCT Pub. Date: May 26, 2017

(65) Prior Publication Data

US 2018/0326442 A1 Nov. 15, 2018

(30) Foreign Application Priority Data

Nov. 20, 2015 (DE) ..... 10 2015 015 090

(51) Int. Cl.
*B05B 13/04* (2006.01)
*B05B 12/00* (2018.01)
(Continued)

(52) U.S. Cl.
CPC ..... *B05B 13/0452* (2013.01); *B05B 3/1092* (2013.01); *B05B 5/0426* (2013.01);
(Continued)

(58) Field of Classification Search
None
See application file for complete search history.

(56) References Cited

U.S. PATENT DOCUMENTS 3,570,275 A 3/1971 Weber et al.
4,144,837 A * 3/1979 Johnston ..... B05B 12/122 118/323
(Continued)

FOREIGN PATENT DOCUMENTS

DE 699 02 317 T2 3/2003
DE 10 2007 020287 A1 11/2008
(Continued)

OTHER PUBLICATIONS

International Search Report and Written Opinion for PCT/EP2016/001899 dated Feb. 13, 2017 (14 pages; with English translation).
(Continued)

*Primary Examiner* — Binu Thomas
(74) *Attorney, Agent, or Firm* — Bejin Bieneman PLC

(57) ABSTRACT

The disclosure relates to a coating method for coating a component with a coating agent, comprising the following steps:

moving an application device over a component surface of the component to be coated, delivering a coating agent jet (9) from the application device to the component surface that is to be coated, defining switching points on the component surface for initiating a switching action, in particular for switching on or switching off a coating agent jet, and performing the switching action when one of the switching points is reached.

The disclosure provides the following steps:

marking the switching points on the component surface by generating a switching marking on the component surface at the individual switching points, (Continued)

detecting the switching markings corresponding to the individual switching points during movement of the application device, and performing the switching actions when the switching markings are detected on the component surface.

The disclosure further includes a corresponding coating installation.

19 Claims, 7 Drawing Sheets

(51) Int. Cl.

| | |
|---|---|
| ***B05B 12/12*** | (2006.01) |
| ***B05B 12/16*** | (2018.01) |
| ***B05B 12/20*** | (2018.01) |
| ***B05B 3/10*** | (2006.01) |
| ***B05B 5/04*** | (2006.01) |
| *B05B 14/00* | (2018.01) |
| *B05C 5/02* | (2006.01) |

(52) U.S. Cl.

CPC ..... *B05B 12/00* (2013.01); *B05B 12/12* (2013.01); *B05B 12/16* (2018.02); *B05B 12/20* (2018.02); *B05B 14/00* (2018.02); *B05C 5/0279* (2013.01)

(56) References Cited

U.S. PATENT DOCUMENTS

| | | | | |
|---|---|---|---|---|
| 4,254,433 | A * | 3/1981 | Dewar, Jr. | G05B 19/4182 348/137 |
| 4,783,977 | A | 11/1988 | Gilpatrick | |
| 5,175,018 | A * | 12/1992 | Lee | B05B 12/22 118/679 |
| 5,670,202 | A | 9/1997 | Guzowski et al. | |
| 6,266,835 | B1 | 7/2001 | Henry et al. | |
| 6,451,117 | B1 * | 9/2002 | Farquhar | B05B 12/20 118/504 |
| 6,709,516 | B1 | 3/2004 | Vaehaekuopus et al. | |
| 7,157,122 | B2 | 1/2007 | Strebe | |
| 7,279,045 | B2 | 10/2007 | Strebe | |
| 9,643,194 | B2 | 5/2017 | Wohr et al. | |
| 9,744,560 | B2 | 8/2017 | Fritz | |
| 2001/0036512 | A1 | 11/2001 | Ito et al. | |
| 2010/0183815 | A1 | 7/2010 | Marx et al. | |
| 2012/0219699 | A1 * | 8/2012 | Pettersson | B05B 12/122 118/669 |
| 2013/0257984 | A1 | 10/2013 | Beier et al. | |
| 2014/0205744 | A1 * | 7/2014 | McNutt | E01C 23/163 118/712 |
| 2014/0329013 | A1 * | 11/2014 | Rouaud | B05B 12/22 118/695 |
| 2015/0086723 | A1 | 3/2015 | Bustgens | |
| 2015/0147460 | A1 * | 5/2015 | Manzi | B05B 12/122 118/713 |
| 2015/0375239 | A1 | 12/2015 | Herre et al. | |
| 2015/0375241 | A1 | 12/2015 | Wohr et al. | |
| 2015/0375258 | A1 | 12/2015 | Fritz et al. | |
| 2016/0001322 | A1 | 1/2016 | Fritz et al. | |
| 2017/0136481 | A1 | 5/2017 | Fritz et al. | |
| 2017/0203324 | A1 | 7/2017 | Wohr et al. | |

FOREIGN PATENT DOCUMENTS

| | | | |
|---|---|---|---|
| DE | 10 2010 019612 | A1 | 11/2011 |
| DE | 10 2012 005650 | A1 | 9/2013 |
| DE | 102013002411 | A1 | 8/2014 |
| DE | 102013002412 | A1 | 8/2014 |
| DE | 102013002413 | A1 | 8/2014 |
| DE | 102013002433 | A1 | 8/2014 |
| EP | 2208541 | A2 | 7/2010 |
| EP | 2644392 | A2 | 10/2013 |
| FR | 2673857 | A1 | 9/1992 |
| GB | 1253099 | A | 11/1971 |
| JP | S5724663 | A | 2/1982 |
| WO | 0037739 | A1 | 6/2000 |
| WO | 03066950 | A2 | 8/2003 |

OTHER PUBLICATIONS

International Search Report and Written Opinion for PCT/EP2016/001911 dated Feb. 2, 2017 (12 pages; with English translation).

* cited by examiner

COATING METHOD AND CORRESPONDING COATING INSTALLATION

CROSS-REFERENCE TO RELATED APPLICATIONS

This application is a national stage of, and claims priority to, Patent Cooperation Treaty Application No. PCT/EP2016/001899, filed on Nov. 14, 2016, which application claims priority to German Application No. DE 10 2015 015 090.1, filed on Nov. 20, 2015, which applications are hereby incorporated herein by reference in their entireties.

The disclosure relates to a coating method for coating a component with a coating agent, in particular for painting motor vehicle body components or aviation industry components in a painting installation. The disclosure further includes a corresponding coating installation.

In the painting of motor vehicle bodies or aviation industry components, it is in some cases desirable to paint different parts of the motor vehicle body with different colours. For example, it may be desirable to paint the roof of a motor vehicle body in a different colour than the remainder of the motor vehicle body.

When a rotary atomiser is used as the application device, in the case of such contrast painting the motor vehicle body must be painted twice in succession each time with the desired colour. In the second painting operation, the surface regions of the motor vehicle body that are not to be painted with the new colour must then be masked. This masking of the motor vehicle body is complex.

It is further known from the prior art (e.g. DE 10 2013 002 433 A1, DE 10 2013 002 413 A1, DE 10 2013 002 412 A1, DE 10 2013 002 411 A1) to use application devices and application processes which deliver a narrowly limited coating agent jet and therefore permit sharply contoured coating or painting.

This sharply contoured coating applied without a mask that is described in the above-mentioned prior art does not produce any paint or coating agent losses due to overspray. Such resource-efficient methods are advantageous for a large number of applications, such as, for example, for coating processes.

The desired and advantageous sharp edges of the painting path generated by such applicators requires a substantially higher accuracy of the switch-on and switch-off locations in comparison with atomising applicators.

When such application devices are used for painting motor vehicle bodies with contrasting colours, it is necessary that the coating agent jet is switched on and switched off at specific switching points. At the transition from a region that is not to be painted to a region that is to be painted, the coating agent jet must be switched on at the boundary between the two regions. Conversely, at the transition from a region that is to be painted to a region that is not to be painted, the coating agent jet must be switched off at the boundary between the two regions. It is therefore known from the prior art to program specific switching points on the component surface of the motor vehicle bodies that are to be painted, at which switching points the coating agent jet is switched on or switched off. These switching points are conventionally programmed on the basis of defined CAD data (CAD: computer aided design) of the motor vehicle body in question.

A problem here is the fact that spatial deviation can occur in practice between, on the one hand, the switching points that are actually desired and, on the other hand, the switching points that are achieved in practice.

A possible reason for such deviations between the desired switching points on the one hand and the switching points achieved in practice on the other hand is a deviation of the actual outer shape of the motor vehicle body from the defined CAD data.

Another possible reason for such deviations is the signal transit times from the robot control to the coating agent valve which releases or blocks the coating agent jet. For example, a robot control can have a cycle time of a control cycle of 4 ms, which in the case of a travelling speed of, for example, 1000 mm/s results in a distance traveled of, for example, 4 mm, it also being possible for this distance traveled to add up over a number of control cycles of the robot control. This signal transit time from the robot control to the coating agent valve leads to a delayed switching operation and thus to a displacement of the actual switching point relative to the desired switching point.

A further possible reason for deviations between the desired switching points on the one hand and the switching points achieved in practice on the other hand is the positioning of the motor vehicle body along the painting line, since this positioning does not take place absolutely exactly. The motor vehicle bodies to be painted are conveyed through the painting installation along the painting line by a conveyor, the conveyor having a certain positioning inaccuracy. Without suitable compensation, this positioning inaccuracy leads to a corresponding spatial deviation between the desired switching points on the one hand and the switching points achieved in practice on the other hand.

The spatial deviation between the desired switching points on the one hand and the switching points achieved in practice on the other hand is associated with various disadvantages.

In order to achieve a flawless coating result, the programmed switching points must be brought forward so that sufficient coating is achieved in practice even taking into account a possible displacement of the switching point, this bringing forward of the programmed switching point leading to increased paint consumption and being associated with an outlay in terms of programming.

In addition, switch-on and switch-off times may not always exactly be reproducible in practice because the signals of the robot control do not always switch in the same control cycle.

Furthermore, there is also the risk of under-coating if, for example, the switch-off point is too early due to the effect of a fault.

From US 2012/0 219 699 A1 there is known a coating method in which the component to be coated is calibrated by means of a camera in order to determine the exact relative position of the component to be coated in relation to the application device. However, a definition of switching points is not known therefrom. The reference markings on the component surface thus serve here merely for measuring the relative position of the component to be coated in relation to the application device.

Finally, reference is also to be made in relation to the general technical background to US 2001/0036512 A1.

DETAILED DESCRIPTION

Figure 1:
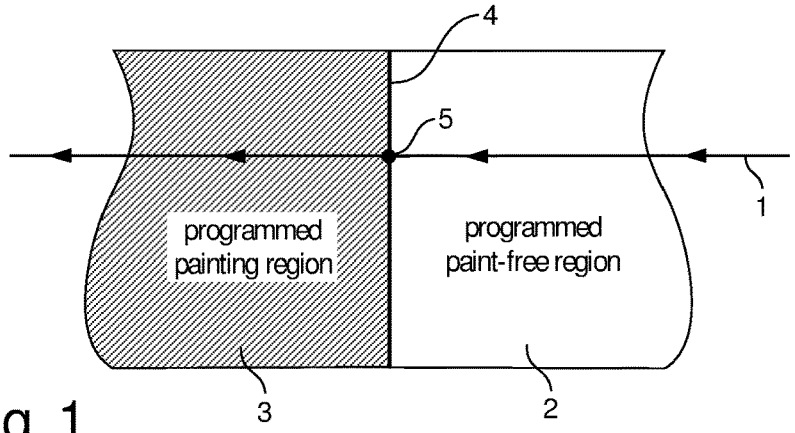
Fig. 1 Prior art
FIG. 1 is a schematic representation of a conventional path painting system, wherein the actual switching point corresponds exactly to the programmed switching point.

The coating method according to the disclosure first provides, in conformity with the prior art, that an application device is moved over a component surface of the component (e.g. motor vehicle body component) to be coated, in particular by a multi-axis coating robot with serial kinematics, the application device preferably being moved over the component surface along a programmed painting path. The applicator can, however, also be guided over the component by means of a different single- or multi-axis movement device.

The coating method according to the disclosure further provides, in conformity with the prior art, that the application device delivers at least one coating agent jet of a coating agent (e.g. paint) onto the component surface to be coated while the application device is moved over the component surface.

In the coating method according to the disclosure too, specific switching points are hereby defined on the component surface to be coated, at which switching points a switching action is to be initiated, such as, for example, the switching on or switching off of the at least one coating agent jet.

As the application device moves over the component surface, the desired switching action (e.g. switching on or switching off of the at least one coating agent jet) is then performed when a switching point is reached.

In the known coating method described at the beginning, the switching points are only programmed on the component surface and are thus not visible on the component surface itself. This leads to the above-described problems, since the actual switching points may differ spatially from the programmed switching points.

The disclosure solves this problem by marking the programmed switching points on the component surface by means of switching markings, the individual switching markings each corresponding to a switching point.

When the application device moves over the component surface, it is constantly checked whether a switching marking is reached. When a switching marking is detected, the desired programmed (expected) switching action (e.g. switching on or switching off of the coating agent jet) is then performed.

In a preferred embodiment of the disclosure, the switching markings are optical switching markings which are generated by means of a light source, in particular by means of a laser or a laser diode. For this purpose, the light source beams a suitable light marking (e.g. point of light, line of light) onto the component surface in order to mark the switching point with a corresponding switching marking.

The optical switching markings on the component surface are detected by means of an optical sensor (e.g. camera, CCD sensor).

In an example of the disclosure, the application device is moved over the component surface by a multi-axis coating robot with serial robot kinematics, which is known per se from the prior art and therefore will not be described in greater detail.

The movement of the coating robot is controlled by a robot control, which is likewise known per se from the prior art.

The generation of the switching markings, the detection of the switching markings and/or the switching on and switching off of the application device, on the other hand, are preferably not controlled by a robot control but by a switching point control.

This division of tasks between the robot control on the one hand and the switching point control on the other hand in one example allows the dynamic response behaviour of the switching point control, and thus the speed of the response to the switching markings, to be not limited by the duration of the control cycle of the robot control. The robot control can operate with a control cycle of, for example, 4 ms, since this control cycle is sufficiently short for the movement of the application device. The switching point control, on the other hand, can operate with a shorter control cycle in order to permit as quick a response as possible to the detected switching markings. It is thereby prevented that, upon detection of the individual switching markings, undesirable switching delays occur between the detection of the switching marking and the performance of the switching action (e.g. switching on or switching off of the coating agent jet).

In a variant of the disclosure, the switching point control is integrated into the robot control. For example, the switching point control on the one hand and the robot control on the other hand can be in the form of separate software modules or separate hardware modules in a common control unit.

By contrast, in another variant of the disclosure, the switching point control is separate from the robot control, that is to say the two controls are not arranged in a common control unit. Here too, the switching point control on the one hand and the robot control on the other hand can be in the form of separate hardware modules or separate software modules.

It has already been mentioned above that the desired switching points are marked on the component surface by switching markings, for example by optical switching markings which are beamed onto the component surface by a laser. The generation of these switching markings on the component surface is preferably carried out taking into account CAD data of the component to be coated, the CAD data describing the spatial form of the component. In addition, the spatial position of the component to be coated is preferably determined, for example by reading a conveyor encoder on the conveyor of the painting line. The spatial position of the switching markings on the component surface is then defined in dependence on the CAD data and in dependence on the spatial position of the component to be coated.

It is further possible within the scope of the disclosure that further switching points located upstream or downstream along the path movement are derived from the defined switching point marked by switching markings. For example, an upstream switching point which is located before the switching point on the painting path can be derived from the actual switching point. Furthermore, a downstream switching point which is located after the switching point on the painting path can be derived from the switching point marked by switching markings. Different switching actions can then be performed at the upstream switching point, the switching point and the downstream switching point.

For example, a coating agent valve which releases the coating agent jet can be opened at the upstream switching point. At this time, an intercepting device, which intercepts the delivered coating agent jet so that the coating agent jet does not initially reach the component surface, initially remains active.

At the actual switching point, the intercepting device is switched to inactive, so that the coating agent jet strikes the component surface immediately after the switching time.

At a first downstream switching point, the intercepting device can be switched to active again so that the coating agent jet no longer strikes the component surface immediately after the switching time.

Finally, at a second downstream switching point, the coating agent valve can be closed so that the coating agent jet is switched off.

The use of such an intercepting device provides the possibility of being able to switch the coating agent jet on or off relatively suddenly, no transient transitional conditions occurring.

The above-mentioned intercepting device is also described in detail as regards its construction and operation in the applicant's parallel German Patent Application No. 10 2015 015 092.8 entitled "Coating apparatus and corresponding operating process", which was filed at the same time (corresponding to U.S. patent application Ser. No. 15/775,037, filed on May 10, 2018). The content of this parallel German patent application is therefore to be incorporated in its entirety into the present application as regards the construction and operation of the intercepting device.

It should further be mentioned that the expression "switching action" used within the scope of the disclosure is to be interpreted generally and is not limited to the switching on and switching off of the coating agent jet. Rather, a fluid stream in general can also be switched on and switched off, such as, for example, an air stream or a guiding air stream of an atomiser. In addition, the switching action can consist in the switching on or switching off of an electrostatic coating agent charge. The switching action can further consist in the above-mentioned activation or deactivation of an intercepting device or of an actuator in general. It should also be mentioned in this connection that the switching action does not necessarily consist in a qualitative changeover between two states (ON/OFF). Rather, it is also possible within the scope of the disclosure that a switching action consists in a continuous change of an operating parameter.

It has already been mentioned above that the switching markings are preferably optical switching markings which are preferably generated by irradiating the component surface with light. It should be mentioned in this connection that the light for generating the switching markings can be in the visible wavelength range, in the infra-red wavelength range or in the ultraviolet wavelength range.

In a variant of the disclosure, the light of the light source is wide-band with a wavelength spectrum having a bandwidth of at least 100 nm, 250 nm or 500 nm.

However, it is also possible, as an alternative, that the light of the light source has a narrow-band wavelength spectrum having a bandwidth of not more than 50 nm, 25 nm, 10 nm or not more than 1 nm, in order to reduce the susceptibility to faults due to ambient light, the optical sensor then being sensitive in a narrow-band wavelength range which lies within the wavelength spectrum of the light source.

With regard to the light source, it should also be mentioned that the light source can be arranged either fixed or spatially movable. However, in each case it is provided that the light source is able to move the light beam spatially in order to generate the optical switching marking at the desired point on the component surface.

With regard to the switching marking on the component surface, it should be mentioned that the switching marking can be an area of light, a strip of light or a point of light or can contain a light pattern.

For example, the switching marking can mark in a linear manner an outline of a sub-area on the component surface that is to be coated, the sub-area to be coated in this case being enclosed by a strip of light. Alternatively, the switching marking can mark the entirety of a sub-area on the component surface that is to be coated. It is further possible that the switching points are marked in point form.

With regard to the coating agent, the disclosure is not limited to paint but can also be carried out with other coating agents, such as, for example, adhesive, sealant or insulating material, to mention only a few examples.

As regards the application device used too, the disclosure is not limited to a particular type of application device. For example, the application device can be an atomiser, such as, for example, a rotary atomiser. Alternatively, an application device can be used which applies a jet of droplets of the coating agent jet or a cohesive coating agent jet. Such application devices are known from patent applications DE 10 2013 002 412 A1 (corresponding to US 2015/0375,258 A1), DE 10 2013 002 413 A1 (corresponding to US 2015/0375,241 A1), DE 10 2013 002 433 A1 (corresponding to US 2016/0001,322 A1) and DE 10 2013 002 411 A1 (corresponding to US 2015/0375,239 A1) already mentioned at the beginning, so that the content of those patent applications is to be incorporated in its entirety into the present description as regards the construction and functioning of the application device.

It should further be mentioned that the disclosure is suitable not only for the coating of motor vehicle body components or attached parts for motor vehicles. Rather, other types of components can also be coated within the scope of the disclosure.

With regard to the switching points, it should be mentioned that they may indicate a boundary between a paint-free region and a region that is to be painted.

It should further be mentioned that the optical sensor may be connected mechanically to the application device and is moved synchronously with the application device over the component surface.

The optical sensor preferably has a detection region which moves ahead of the movement of the application device. The optical sensor may look ahead at the programmed painting path in order to be able to detect a switching marking on the component surface in good time.

Alternatively, it is also possible, however, that the optical sensor is arranged separately from the application device, for example stationarily.

Finally, it should be mentioned that the disclosure also claims protection for a coating installation according to the disclosure which carries out the coating method described above. The construction and functioning of this coating installation according to the disclosure are already apparent from the preceding description, so that a separate description of the coating installation is not required.

Figure 2:
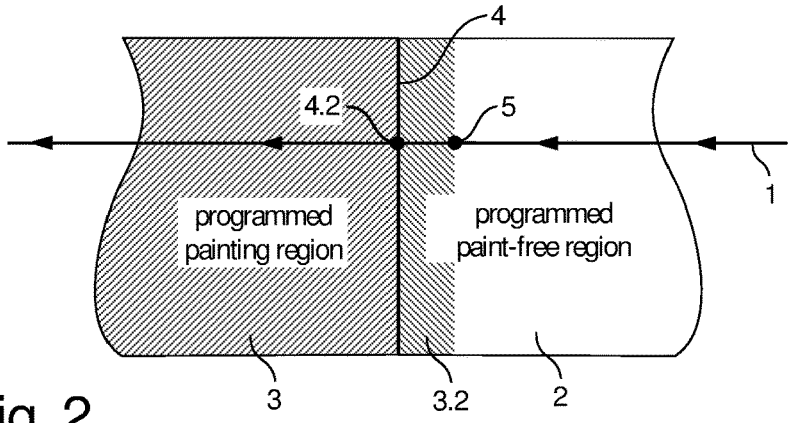
Fig. 2 Prior art
FIG. 2 shows a modification of FIG. 1, wherein the actual switching point is located on the path before the programmed switching point.
Figure 3:
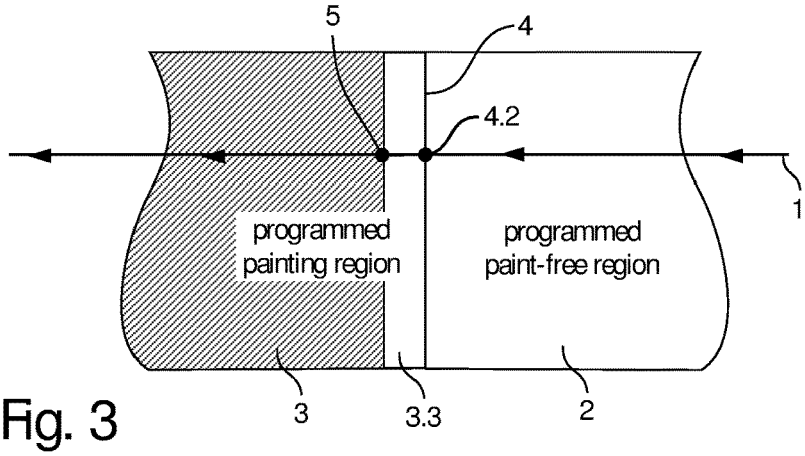
Fig. 3 Prior art
FIG. 3 shows a modification of FIG. 1, wherein the actual switching point is located on the path after the programmed switching point.

FIGS. 1 to 3 first show various diagrams to illustrate a path-oriented painting process. An application device is guided over a component surface along a painting path 1, the application device first passing through a defined (programmed) paint-free region 2 and then reaching a defined (programmed) painting region 3, which is to be painted. The painting region 3 is separated from the paint-free region 2 by a boundary 4. At the boundary 4 between the paint-free region and the painting region 3 there is a programmed switch-on point 4.2 at which the application device is to be switched on so that the application device subsequently paints the painting region 3 on the painting path 1.

It should be noted here that, in practice, the actual switch-on point 5 differs from the programmed switch-on point 4.2, which leads to coating defects, as will be described hereinbelow.

In the diagram according to FIG. 1, the actual switch-on point 5 coincides with the programmed switch-on point 4.2 and is located exactly at the boundary 4, so that no deviation occurs between the programmed desired switch-on point 4.2 and the actual switch-on point 5.

In the diagram according to FIG. 2, on the other hand, the actual switch-on point 5 is located on the painting path 1 before the boundary 4 between the programmed paint-free region 2 and the programmed painting region 3. In this case there is thus undesirable coating of the paint-free region 2 between the switch-on point 5 and the boundary 4 in a region 3.2 which should actually be paint-free.

FIG. 3, on the other hand, shows a modification in which the actual switch-on point 5 is located on the painting path 1 after the boundary 4 between the programmed paint-free region 2 and the programmed painting region 3. This has the result that there is under-coating in a region 3.3 in the programmed painting region 3 on the painting path 1 between the boundary 4 and the switch-on point 5.

FIGS. 2 and 3 thus show various undesirable deviations between the actual switching point 5 and the programmed switching point 4.2. These undesirable deviations are prevented or at least reduced by the disclosure.

Figure 4:
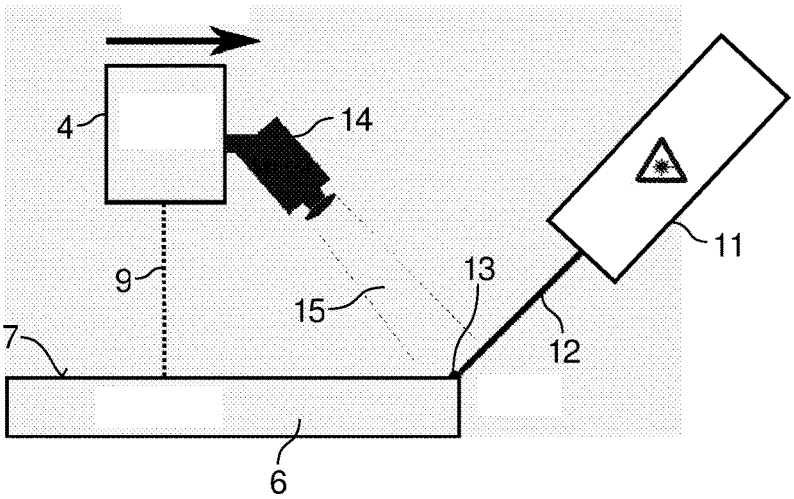
FIG. 4 is a schematic representation of a coating installation according to the disclosure which detects switching markings on the component surface.
Figure 5:
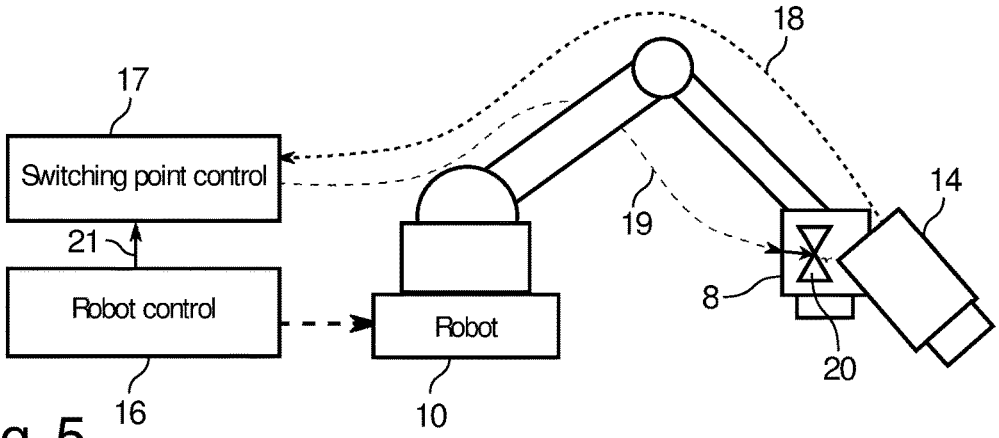
FIG. 5 is a different representation of the coating installation of FIG. 4 with an additional switching point control and a robot control.
Figure 6:
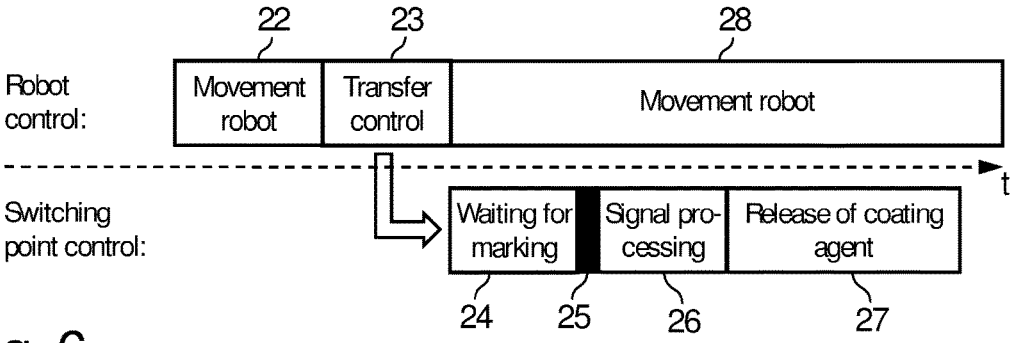
FIG. 6 is a control diagram to illustrate the division of work between the robot control and the switching point control according to FIG. 5.

Reference will therefore now be made to the embodiment according to FIGS. 4 to 6. The drawings show a component 6 (e.g. motor vehicle body component) to be coated, which has a component surface 7 to which an application device 8 applies a coating agent jet 9, which is known per se from the prior art and therefore does not have to be described in greater detail.

The application device 8 is guided over the component surface 7 along the painting path 1 by a multi-axis coating robot 10 with serial robot kinematics, which is likewise known per se from the prior art.

The drawings further show a laser 11 which directs a laser beam 12 at the component surface 7 and thereby generates an optically visible switching marking 13 on the component surface 7. The laser beam 12 can be deflected by a suitable deflection device in such a manner that the switching marking 13 is generated at the desired position on the component surface 7. The positioning of the switching markings 13 takes place in dependence on defined CAD data of the component 6 and in dependence on the measured position of the component 6.

The drawings additionally show that an optical sensor 14 is mounted on the application device 8, the optical sensor 14 being guided over the component surface 7 by the coating robot 10 together with the application device 8.

The optical sensor 14 (e.g. camera) has a detection region 15 which moves along the painting path 1 ahead of the coating agent jet 9. When moving along the painting path, the optical sensor 14 can thus detect in advance whether one of the switching markings 13 becomes detectable on the component surface 7. Because the optical sensor 14 looks ahead in this manner, there is sufficient time to switch on or switch off the coating agent jet 9, so that the coating agent jet 9 is switched on or switched off as exactly as possible as it passes the switching marking 13.

It can further be seen from FIG. 5 that the coating robot 10 is controlled by a conventional robot control 16.

A separate switching point control 17 is additionally provided, which is connected on the input side via a signal path 18 to the optical sensor 14 in order to detect one of the switching markings 13 on the component surface 7. On the output side, on the other hand, the switching point control 17 is connected via a signal path 19 to a coating agent valve 20 in the application device 8, in order to be able to switch on or switch off the coating agent jet 9.

The robot control 16 is additionally connected via a signal path 21 to the switching point control 17, so that the robot control 16 is able to transfer control of the placing of switching signals to the switching point control 17, as is shown in FIG. 6 and will be described hereinbelow.

In an operating phase 22, only the robot control 16 controls the coating robot 10.

In a following operating phase 23, the robot control 16 then transfers control to the switching point control 17, since the robot control 16 detects that a programmed switching point is approaching.

In an operating phase 24, the switching point control 17 checks, by interrogating the optical sensor 14, whether one of the switching markings 13 has been detected.

In the operating phase 25, one of the switching markings is then detected by the switching point control 17. The switching point control 17 then begins to control a process. The term "process" is here to be interpreted generally and can consist, for example, in controlling the coating agent valve 20. Very generally, however, the "process" can also consist in controlling an air stream, a paint flow or in switching (switching on or switching off) power or light, to mention only a few examples.

During an operating phase 27, the coating agent valve 20 in the application device 8 opens, whereby the coating agent jet 9 is released.

In parallel, the robot control 16 continues to control the coating robot 10 during an operating phase 28.

The above-described division of tasks between the robot control 16 on the one hand and the switching point control 17 on the other hand is useful, as will be explained in the following. The robot control 16 conventionally controls the coating robot 10 with a specific control cycle of, for example, 4 ms. During this control cycle, with a speed of travel of, for example, 1000 mm/s, there is a certain distance traveled of, for example, 4 mm, so that the robot control 16 could position the switching point 13 only with a corresponding position inaccuracy.

The switching point control 17, on the other hand, is able to operate substantially more quickly and therefore also react substantially more quickly to the switching markings 13.

Figure 7:
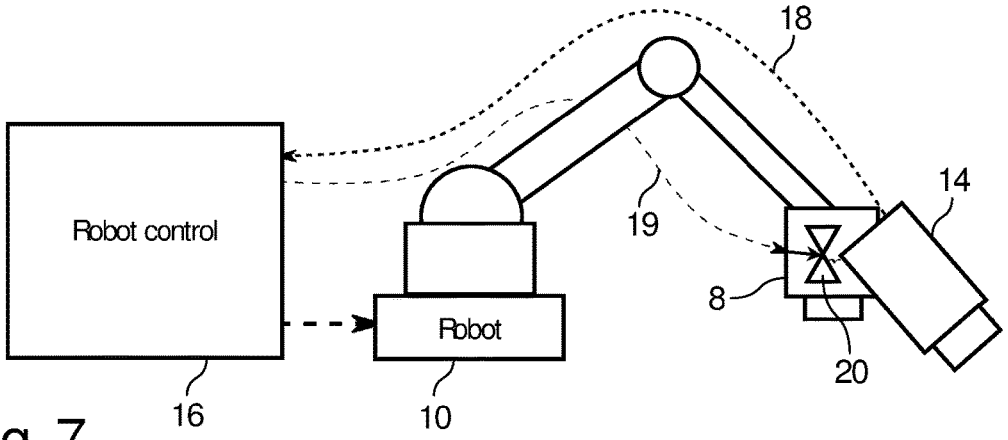
FIG. 7 is a modification of FIG. 5.

FIG. 7 shows a modification of the exemplary embodiment according to FIGS. 4 to 6 so that, in order to avoid repetition, reference is made to the above description, the same reference numerals being used for corresponding details.

A feature of this example is that the switching point control 17 is integrated into the robot control 16.

Figure 8:
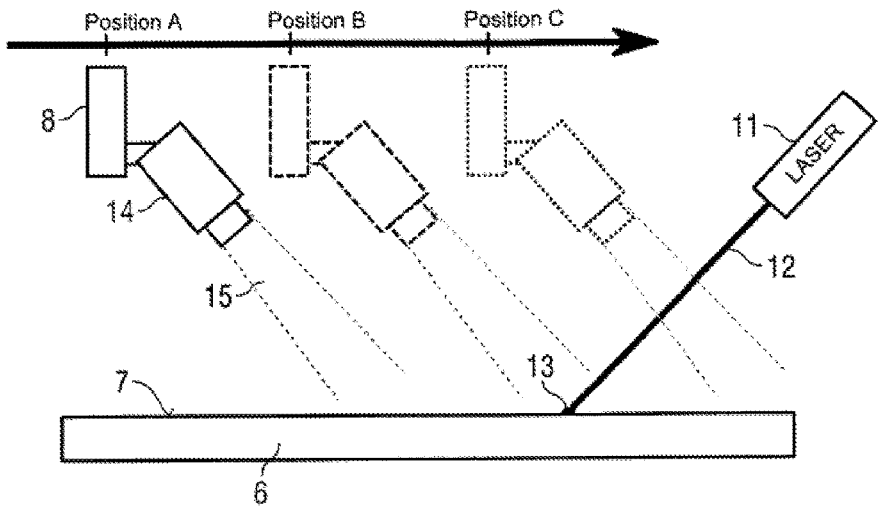
FIG. 8 is a schematic representation to illustrate the disclosure.

FIG. 8 shows different positions A, B and C of the application device 8 along a programmed painting path, wherein position A is shown with a solid line, while position B is depicted by a broken line, whereas position C is reproduced by a dotted line.

In position A, the optical sensor 14 cannot yet detect the switching marking 13 on the component surface 7. In position B, on the other hand, the switching marking 13 on the component surface 7 is situated within the detection region 15 of the optical sensor 14, so that a switching action (e.g. switching on or switching off of the coating agent jet 19) is initiated.

Figure 9:
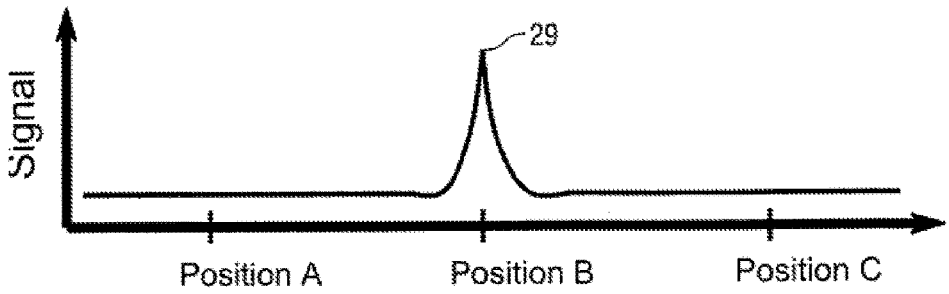
FIG. 9 is a signal diagram of the output signal of the sensor for detecting the switching markings.

FIG. 9 shows the associated output signal of the optical sensor 14, a peak 29 being visible at position B, which indicates the detection of the switching marking 13.

Figure 10:
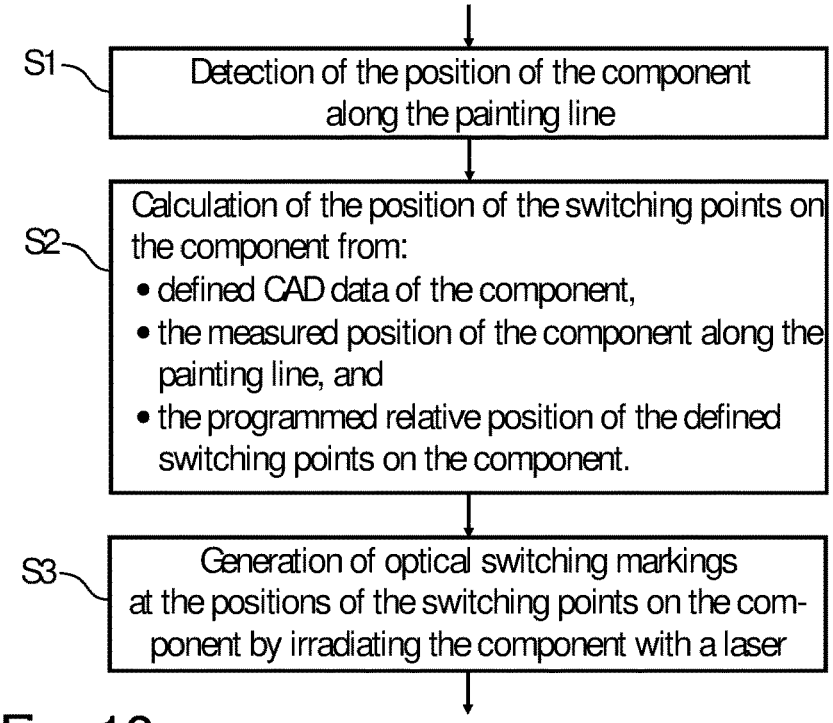
FIG. 10 is a flow diagram to illustrate the generation of the switching markings on the component surface.

FIG. 10 shows a flow diagram to illustrate the generation of the switching markings 13 on the component surface 7 of the component 6 to be coated.

In a first step S1, the position of the component 6 along the painting line is first detected. This can take place, for example, by reading a conveyor encoder of the conveyor of the painting line, which is known per se from the prior art.

Then, in a step S2, the position of the desired switching points on the component 6 is calculated. On the one hand, CAD data of the component 6, which describe the spatial form of the component 6, are hereby taken into account. On the other hand, the measured position of the component 6 along the painting lines is also taken into account. Finally, the programmed relative position of the defined switching points on the component 6 is also taken into account, that is to say detected in a component-related coordinate system.

In a further step S3, the switching markings 13 are generated on the component surface 7 by the laser 11 directing the laser beam 12 at the component surface 7.

Figure 11:
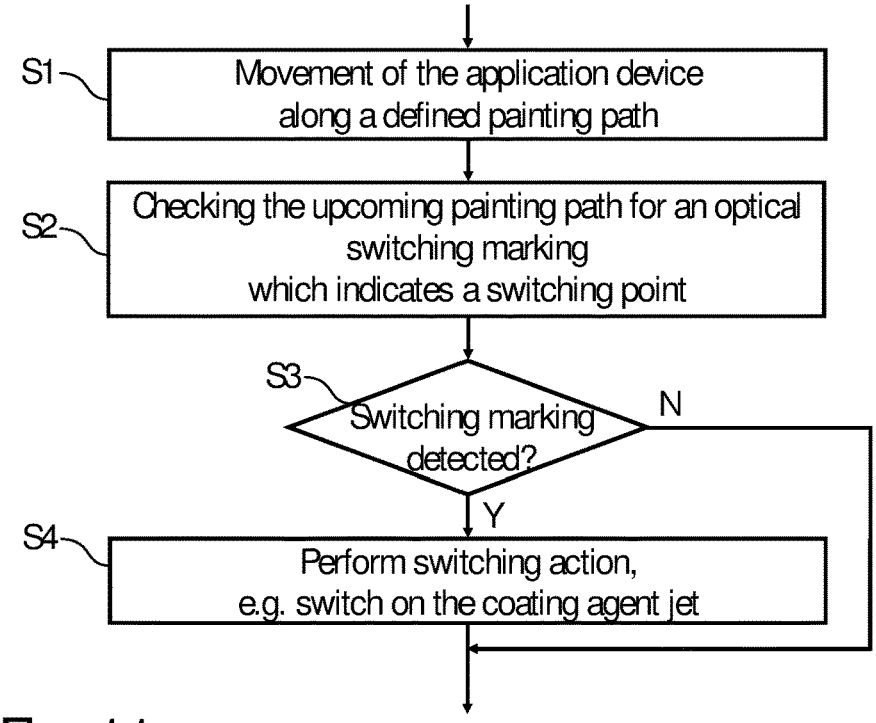
FIG. 11 is a flow diagram to illustrate the detection of the switching markings on the component surface.

FIG. 11 shows a flow diagram to illustrate the operation of the switching point control 17 upon detection of the switching markings.

In a step S1, the application device 8 is moved over the component surface 7 along a painting path by the coating robot 10.

In a step S2, it is continually checked whether the switching marking 13, which indicates a switching point, is visible on the upcoming painting path.

If such a switching marking 13 is detected, a transfer is made in a step S3 to a step S4, in which the desired switching action, such as, for example, the switching on or switching off of the coating agent jet 9, is performed.

Figure 12A:
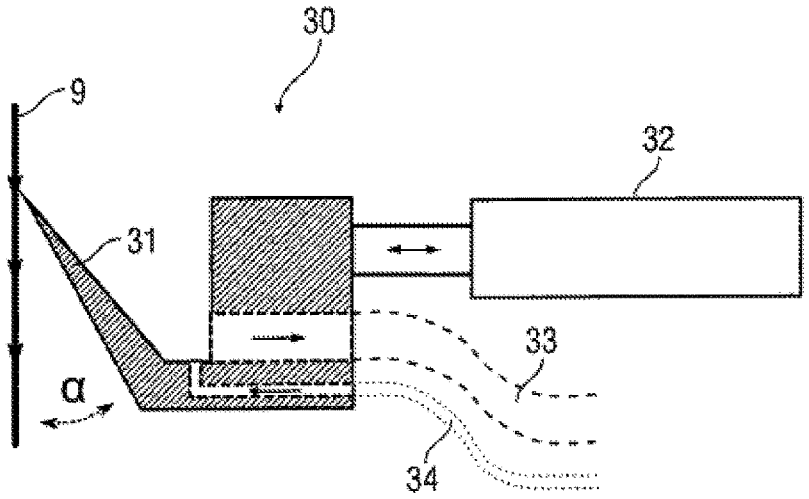
FIG. 12A is a schematic representation of an intercepting device for intercepting the coating agent jet in the inactive state.
Figure 12B:
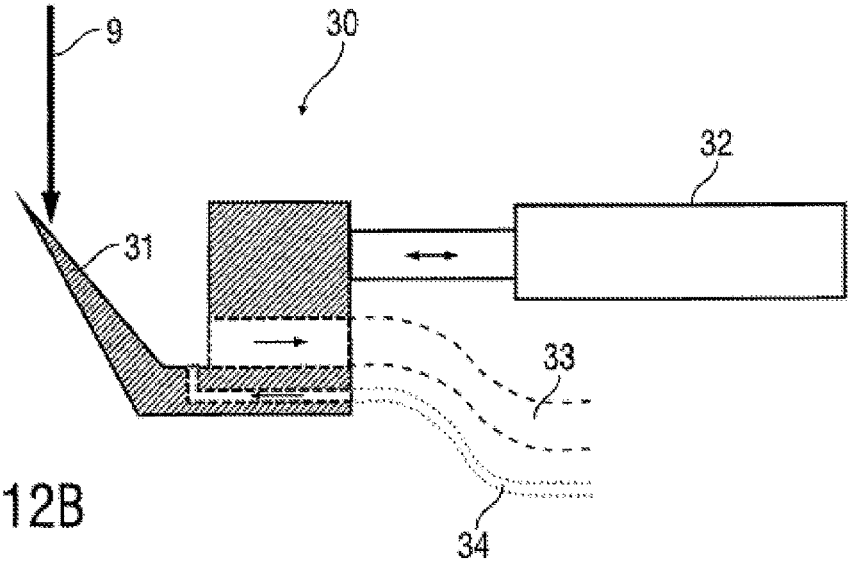
FIG. 12B shows the intercepting device from FIG. 12A in the activated state.

FIGS. 12A and 12B show an intercepting device 30 according to the disclosure for intercepting the coating agent jet 9.

The intercepting device 30 consists substantially of a linearly displaceable cutter 31 which is linearly displaceable in the direction of the double arrow by an actuator 32 in order either to intercept (see FIG. 12B) or to release (see FIG. 12A) the coating agent jet 9. The actuator 32 can be controlled by switching points on the component surface 7, as will be described in detail below.

The drawings additionally also show a suction line 33 and a fluid feed line 34. The suction line 33 serves to remove by suction the intercepted coating agent when the intercepting device 30 is in the active state according to FIG. 12B. The fluid feed line 34, on the other hand, serves to supply a flushing agent so that the coating agent in the intercepting device 30 does not form clumps.

Figure 13:
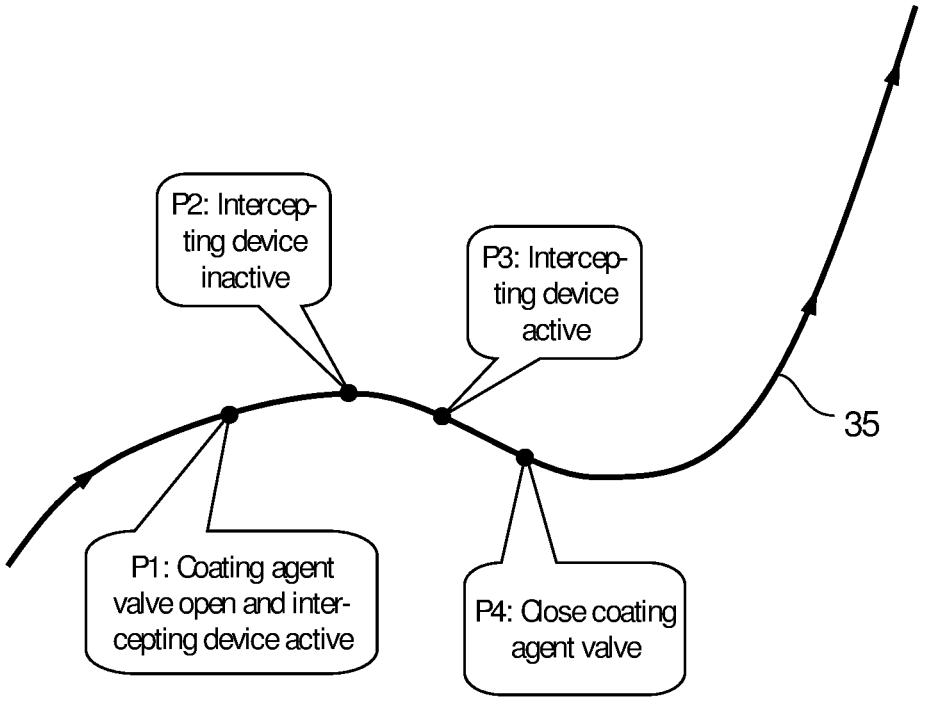
FIG. 13 is a diagram to illustrate an upstream switching point, a switching point and two downstream switching points on a programmed robot path.

FIG. 13 shows the movement of an application device along a painting path 35, a plurality of points P1, P2, P3 and P4 being passed in succession.

Point P2 is the actual switching point, which is indicated by a switching marking 13 on the component surface. At the switching point P2, the intercepting device 30 is switched to inactive, as is shown in FIG. 12A, so that the coating agent jet 9 is able to strike the component surface 7.

The coating agent valve 20 has already been opened previously at point P1.

In the following step P3, the intercepting device 30 is then switched to active, as is shown in FIG. 12B, so that the coating agent jet 9 no longer strikes the component surface.

Finally, the coating agent valve 20 is closed at point P4, so that a coating agent jet 9 is no longer delivered.

It has already been mentioned briefly above that point P2 is the actual switching point, which is indicated by the switching marking 13.

Point P1, on the other hand, is an upstream switching point which is derived from the switching point P2.

Points P3 and P4 are also derived from the actual switching point P2 and are situated after the actual switching point P2 on the painting path 35.

The disclosure is not limited to the preferred embodiments described above. Rather, a large number of variants and modifications is possible, which likewise make use of the inventive concept and therefore fall within the scope of protection. In particular, the disclosure also claims protection for the subject matter and the features of the dependent claims, independently of the claims on which they are each dependent and in particular also without the characterising features of the main claim.

LIST OF REFERENCE NUMERALS

1 Painting path
2 Paint-free region
3 Painting region
3.2 Region of the paint-free region that is coated in error
3.3 Region of the painting region that is not coated in error
4 Boundary between paint-free region and painting region
4.2 Programmed switch-on point
5 Actual switch-on point
6 Component
7 Component surface
8 Application device
9 Coating agent jet
10 Coating robot
11 Laser
12 Laser beam

13 Switching marking
14 Optical sensor
15 Detection region of the optical sensor
16 Robot control
17 Switching point control
18 Signal path from the sensor to the switching point control
19 Signal path from the switching point control to the coating agent valve
20 Coating agent valve
21 Signal path from the robot control to the switching point control
22-28 Operating phases
29 Peak of the sensor signal at the switching marking
30 Intercepting device
31 Cutter for intercepting the coating agent jet
32 Actuator for displacing the cutter
33 Suction line
34 Fluid feed line
35 Painting path
P1-P4 Switching points

The invention claimed is:

1. Coating installation for coating a surface of a component with a coating agent, comprising:

a) a marking device for generating switching points on the surface of the component to be coated, the switching points indicating switching points at which the coating installation is to perform a switching action, and b) a sensor for detecting the switching points on the component surface c) a switching point control for controlling the switching actions, the switching point control generating the switching points based on CAD data of the component to be coated and a spatial position of the component, d) the switching point control being connected on an input side to the sensor in order to detect the switching points, e) while the switching point control is connected on an output side to an actuator in order to initiate the switching action when the sensor detects one of the switching points on the component surface;

f) an application device for delivering a coating agent jet to the component surface, wherein the application device responds to the switching action such that the coating agent is either switched on or off.

2. Coating installation according to claim 1, wherein a) the marking device has a light source and generates the switching marking on the surface of the component, and b) the sensor is an optical sensor.

3. Coating installation according to claim 1, further comprising a) a multi-axis coating robot which guides the application device over the component surface, and b) a robot control which controls the coating robot so that the application device performs a programmed movement over the component surface.

4. Coating installation according to claim 2, wherein the switching point control is integrated into a robot control.

5. Coating installation according to claim 4, wherein the switching point control and the robot control are in the form of separate software modules in a common control unit.

6. Coating installation according to claim 4, wherein the switching point control on the one hand and the robot control on the other hand are in the form of separate hardware modules in a common control unit.

7. Coating installation according to claim 3, wherein the switching point control is separate from the robot control.

8. Coating installation according to claim 7, wherein the switching point control and the robot control are in the form of separate hardware modules.

9. Coating installation according to claim 1, wherein a) for intercepting a coating agent jet, an intercepting device is provided, b) the intercepting device is movable between an active intercepting position and an inactive position, the intercepting device including a suction line, c) the intercepting device in the intercepting position removes by suction the coating agent jet and prevents the coating agent jet from reaching the component surface, and d) the intercepting device in the inactive position does not collect the coating agent jet so that the coating agent jet reaches the component surface.

10. Coating installation according to claim 1 wherein the spatial position of the component is detected by reading a conveyor encoder.

11. Coating installation for coating a surface of a component with a coating agent, comprising:

a) a marking device for generating switching points on the surface of the component to be coated, the switching points indicating switching points at which the coating installation is to perform a switching action, and b) a sensor for detecting the switching points on the component surface, c) a switching point control for controlling the switching actions, the switching point control generating the switching points based on CAD data of the component to be coated and a spatial position of the component, d) the switching point control being connected on an input side to the sensor in order to detect the switching points, e) while the switching point control is connected on an output side to an actuator in order to initiate the switching action when the sensor detects one of the switching points on the component surface;

f) an intercepting device that is movable between an active intercepting position and an inactive position, the intercepting device including a suction line, g) the intercepting device in the intercepting position removes by suction the coating agent jet and prevents the coating agent jet from reaching the component surface, and h) the intercepting device in the inactive position does not collect the coating agent jet so that the coating agent jet reaches the component surface wherein the intercepting device is responsive to the switching action.

12. Coating installation according to claim 11, wherein a) the marking device has a light source and generates the switching points on the surface of the component, and b) the sensor is an optical sensor.

13. Coating installation according to claim 11, further comprising a) an application device for delivering a coating agent jet to the component surface, b) a multi-axis coating robot which guides the application device over the component surface, and c) a robot control which controls the coating robot so that the application device performs a programmed movement over the component surface.

14. Coating installation according to claim 12, wherein the switching point control is integrated into a robot control.

15. Coating installation according to claim 14, wherein the switching point control and the robot control are in the form of separate software modules in a common control unit.

16. Coating installation according to claim 14, wherein the switching point control on the one hand and the robot control on the other hand are in the form of separate hardware modules in a common control unit.

17. Coating installation according to claim 13, wherein the switching point control is separate from the robot control.

18. Coating installation according to claim 17, wherein the switching point control and the robot control are in the form of separate hardware modules.

19. Coating installation according to claim 11 wherein the spatial position of the component is detected by reading a conveyor encoder.

* * * * *